US009144724B2

(12) United States Patent
Song

(10) Patent No.: US 9,144,724 B2
(45) Date of Patent: Sep. 29, 2015

(54) ADJUSTABLE MEDALLION FOR GOLF CLUB

(71) Applicant: Acushnet Company, Fairhaven, MA (US)

(72) Inventor: Yu Jin Song, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 181 days.

(21) Appl. No.: 14/038,489

(22) Filed: Sep. 26, 2013

(65) Prior Publication Data

US 2015/0087437 A1 Mar. 26, 2015

(51) Int. Cl.
*A63B 53/04* (2015.01)
*A63B 53/06* (2015.01)

(52) U.S. Cl.
CPC ..... *A63B 53/047* (2013.01)

(58) Field of Classification Search
USPC ..... 473/324–350
See application file for complete search history.

(56) References Cited

U.S. PATENT DOCUMENTS

| | | | | |
|---|---|---|---|---|
| 4,529,204 | A * | 7/1985 | Yamakawa | 473/256 |
| 5,540,436 | A * | 7/1996 | Boone | 473/350 |
| 5,674,133 | A * | 10/1997 | Chang et al. | 473/291 |
| 5,683,309 | A * | 11/1997 | Reimers | 473/337 |
| 6,015,354 | A * | 1/2000 | Ahn et al. | 473/256 |
| 6,592,469 | B2 * | 7/2003 | Gilbert | 473/350 |
| 6,719,641 | B2 * | 4/2004 | Dabbs et al. | 473/291 |
| 6,921,344 | B2 * | 7/2005 | Gilbert et al. | 473/334 |
| 7,048,647 | B2 * | 5/2006 | Burrows | 473/334 |
| 7,201,669 | B2 * | 4/2007 | Stites et al. | 473/337 |
| 7,789,771 | B2 * | 9/2010 | Park et al. | 473/332 |
| 8,057,322 | B2 * | 11/2011 | Wallans | 473/329 |
| 8,187,117 | B2 * | 5/2012 | Blumenkrantz et al. | 473/329 |
| 8,262,495 | B2 * | 9/2012 | Stites | 473/226 |
| 8,409,031 | B2 * | 4/2013 | Stites et al. | 473/335 |
| 8,435,132 | B2 * | 5/2013 | Oldknow et al. | 473/291 |
| 8,491,414 | B2 * | 7/2013 | Dill et al. | 473/335 |
| 8,939,848 | B2 * | 1/2015 | Soracco et al. | 473/329 |

FOREIGN PATENT DOCUMENTS

| | | | | |
|---|---|---|---|---|
| WO | WO 2007044220 A1 * | 4/2007 | | A63B 53/06 |

* cited by examiner

*Primary Examiner* — Alvin Hunter
(74) *Attorney, Agent, or Firm* — Michael J. Mancuso

(57) ABSTRACT

An iron type golf club head body has a back portion with a recess defined by a perimeter wall therein, and the recess having a back surface for attachment of an adjustable medallion. In a set of golf irons, the recess areas are progressively larger as the irons get shorter in length. In lieu of providing a different size medallion for each club head in a set of irons, the adjustable medallion is designed to use one medallion to accommodate an entire set of irons. The medallion consists of top and bottom pieces that can slide to an either small size or an expanded size. An area between the pieces creates a gap that will vary in width depending upon the size of the club head.

20 Claims, 3 Drawing Sheets

ADJUSTABLE MEDALLION FOR GOLF CLUB

FIELD OF THE INVENTION

The present invention generally relates to golf clubs and, more particularly to a set of golf irons utilizing an adjustable medallion that can adapt in overall size to accommodate the different dimensions of a set of golf irons.

BACKGROUND OF THE INVENTION

To help the average golfer consistently hit the sweet spot of a club head, many golf clubs are available having heads with so-called cavity back designs with increased perimeter weighting. Another more recent trend has been to simply increase the overall size of the club heads, especially in the long irons. Each of these features will increase the size of the sweet spot and therefore make it more likely that a shot hit slightly off the center of gravity of the club head still makes contact with the sweet spot and flies farther and straighter as a result. A result of these sets of clubs is a much larger rear surface.

Usually, the rear surface of an iron club has a medallion affixed to it. The medallion may be selected to afford a measure of dampening, weight adjustment or just a place to put the manufacturer's logo. One problem area is that since the irons have various sized heads, it is often necessary to have various sized medallions to fit the different dimensions.

The individual golf club heads in a set typically increase progressively in surface area and weight as the clubs progress from the long irons to the short irons. Thus, because the club heads of long irons (i.e. 2, 3, 4) have smaller rear surface areas than the short irons (i.e. 8, 9), smaller sized medallions are needed as the irons progressively get longer. The present invention provides a solution to the need of various sized medallions.

SUMMARY OF THE INVENTION

Conceptually, the invention includes an iron type golf club head body having a back portion with a recess defined by a perimeter wall therein, and the recess having a back surface for attachment of an adjustable medallion. In a set of golf irons, the recess area of longer irons is significantly smaller than the recess area of the shorter irons. In lieu of providing a different size medallion for each club head in a set of irons, the present invention allows for one adjustable medallion that can accommodate all the irons.

The medallion consists of top and bottom pieces that can slide to an either small size or an expanded size. An area between the pieces creates a gap that will vary in width depending upon the size of the club head. This gap may be filled with materials of varying densities or weights to create a method of adjusting the center of gravity or the moment of inertia of the club head.

The preferred materials for construction of the medallion would be a polymer or metal and the medallion can be affixed to the club head by welding, adhesives or epoxies.

DETAILED DESCRIPTION OF THE PREFERRED EMBODIMENTS

Figure 1:
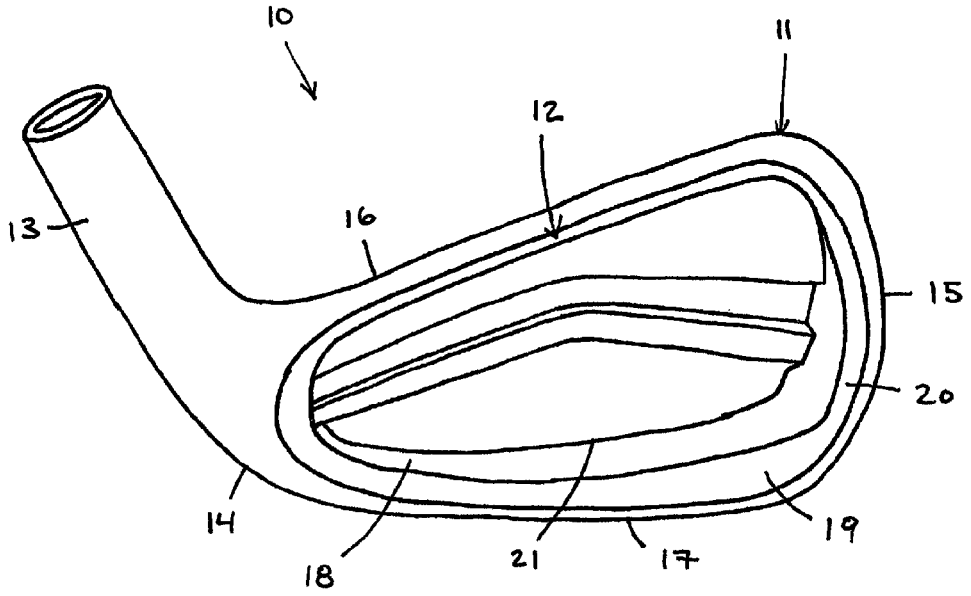
FIG. 1 is a back perspective view of a golf club head with an adjustable medallion mounted thereon.
Figure 2:
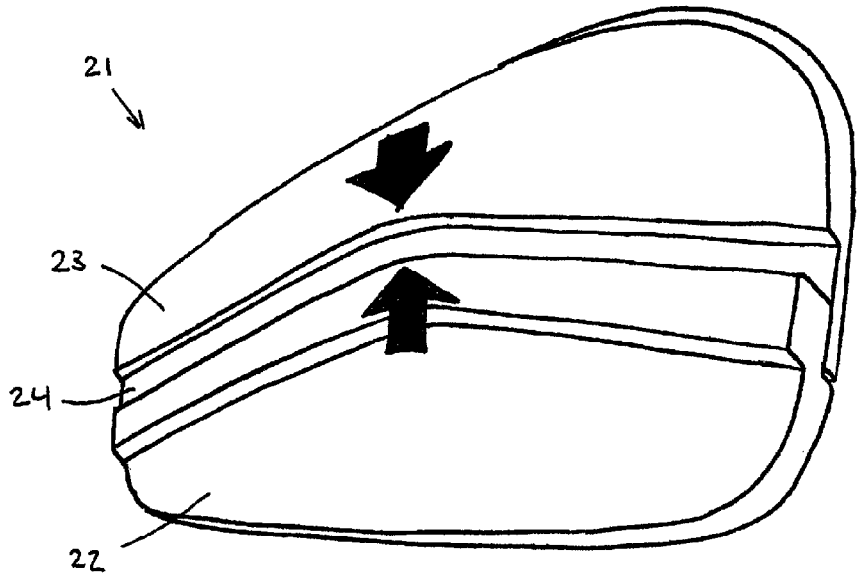
FIG. 2 is a perspective back view of the medallion in a closed position.
Figure 3:
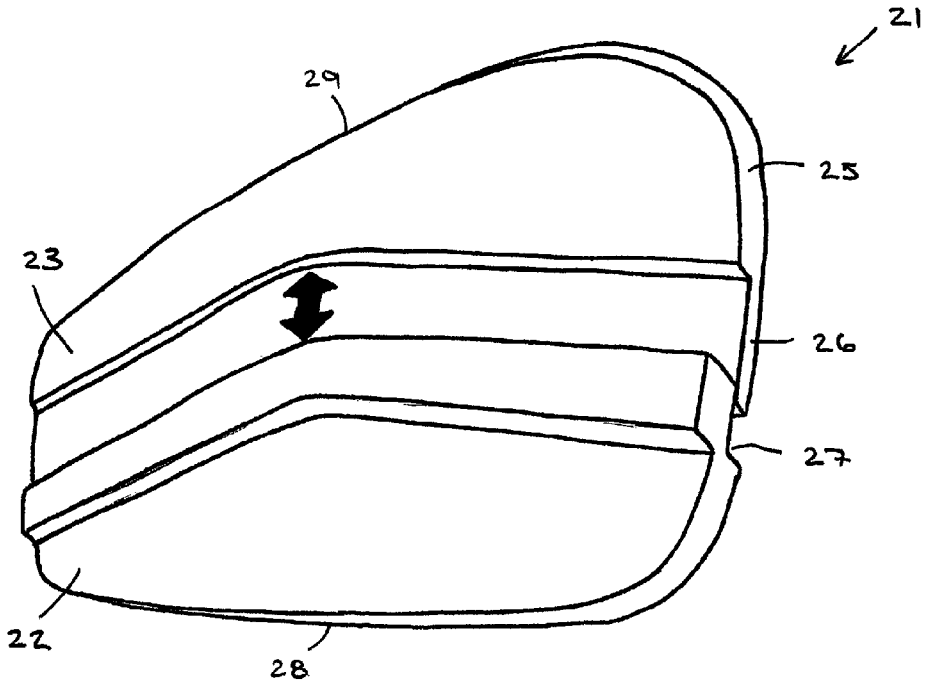
FIG. 3 is a perspective back view of the medallion of FIG. 2 when in a more opened position.

Referring to FIGS. 1-3, golf club head 10 is constructed in accordance with a preferred embodiment of this invention. It includes a body 11, having a back portion 12, a hosel portion 13, a heel portion 14, a toe portion 15, an upper edge 16 and lower edge 17. The back portion 12 includes a recess 18 that is defined by a perimeter wall 19 and a back surface 20 of the club head body 11. A medallion 21 may be mechanically or adhesively fitted within the recess 18.

In the preferred embodiment, recess 18 is preferably formed in the main body structure 11 during the casting process, but may also be formed subsequently by machining. Recess 18 may be partially fitted with a polymer material which can be like a preformed insert. The medallion 21 can be attached mechanically or bonded by an adhesive. Quite often a decorative piece is attached to the medallion 21, such as a logo or indicia. Medallions may also serve as dampeners to absorb some of the vibration from impact that would have been felt by the golfer, and also to absorb some of the impact noise.

The medallion 21 of the present invention is shown on FIGS. 2 and 3, as comprising of two individual parts, a bottom piece 22 and a top piece 23. When connected the two pieces 22, 23 create a gap 24. The gap 24 may be slight as shown in FIG. 2, or quite substantial as seen in FIG. 3. As the pieces 22, 23 are moved further apart, the gap has the potential of being wider.

In a set of golf club irons, the longer irons (i.e. 2, 3, 4) are physically smaller and therefore the cavity back recess is smaller. With the shorter irons (i.e. 8, 9, PW) the cavity back recess is substantially larger. In the past, manufacturers provided a different sized medallion to fit the particular cavity recess for each club head. With the present invention it is possible to require only one medallion for the entire set of clubs by spreading the bottom piece 22 away from the top piece 23 to change the physical size of the medallion 21 to match each club head.

The bottom piece 22 of the medallion has an L-shaped flange 27 that overlaps and may be moved along a thin flange section 26 of the top piece 23 to change the size. The overlap creates a lap joint between the components and allows the size of the medallion to be altered while preventing the attachment surface of the recess of the club head surface from becoming exposed. Inherent in this movement is the creation of the gap 24 with a thicker section 25 of the top piece 23. Once in a pre-sized position, the medallion 21 may fit any club in the set, and may be affixed to the back surface 20 of the recess 18 by any well-known means such as an adhesive, epoxy or mechanical type connection such as tongue and groove. As an alternative, the flange configuration may be reversed so that a flange of the top piece overlaps a flange of the bottom piece. The configuration may be selected based on the order in which the pieces are installed into a golf club head. For example, if the bottom piece is partially inserted into a sole channel, it may be preferred to include a flange on the bottom piece that is overlapped by a flange on the top piece so that the top piece may be installed after the bottom piece is installed. Preferably, the overlapping joint is configured so that the components may be moved relative to each other, while maintaining some overlap of the flanges, from 0.0625 inch to 0.250 inch.

The components of the adjustable medallion 21 may be selected to alter the weight of the medallion and the golf club head including the medallion. The materials of the bottom piece 22 and the top piece 23 may be selected to provide medallions 21 having a variety of weights and weight distributions. For example, in a lightweight medallion both components may be constructed from lightweight materials such as polymers, aluminum and/or titanium. A heavyweight medallion may be constructed by selecting relatively heavy materials for each of the components, such as tungsten loaded polymer, a tungsten alloy or steel. Still further, the center of gravity of the medallion 21 may be altered by utilizing relatively heavy materials for only a portion of the medallion or one of bottom and top pieces 22, 23. As an example, to provide a high center-of-gravity medallion 21 bottom piece 22 is constructed from a lightweight polymer and top piece 23 is constructed from a loaded polymer. It should be appreciated that the material selections apply equally to all of the embodiments described herein so that portions of any adjustable medallion may be weighted to alter the center of gravity of the medallion and the golf club head.

The gap 24 created between the bottom and top pieces 22, 23 may be used to place a weighted member. The center of gravity and Moment of Inertia may be adjusted by the types of weight material i.e. aluminum, plastic, tungsten etc.

Figure 4:
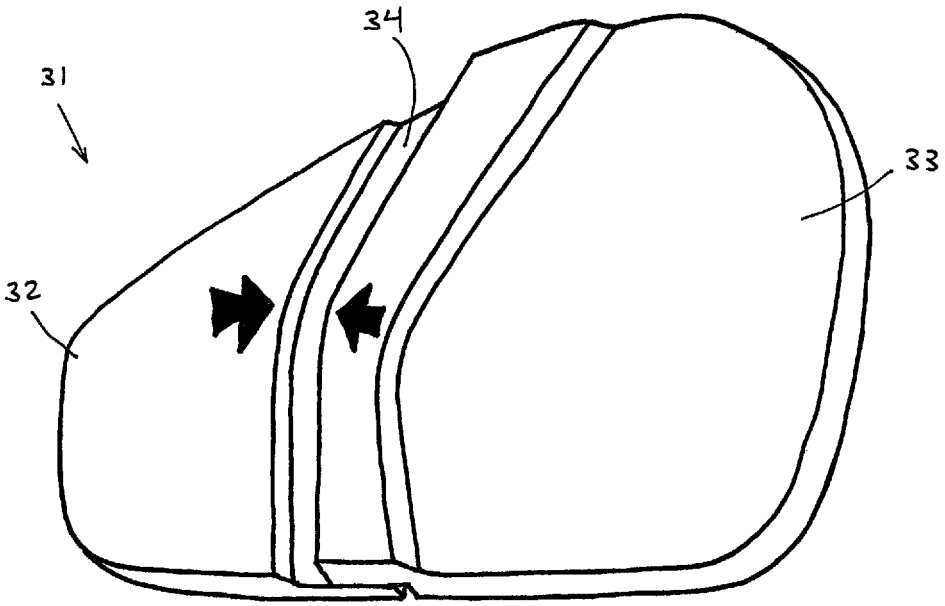
FIG. 4 is a perspective back view of another medallion in a closed position.

Although medallion 21 includes adjustment by including components that overlap and are adjustable relative to each other in the direction of the sole to top edge of golf club head 10, it should be appreciated that a medallion may be adjustable in the heel to toe direction as illustrated in medallion 31 of FIG. 4. The medallion 31 includes two individual parts, a heel piece 32 and a toe piece 33, and when connected, the two pieces 32, 33 create a gap 34. In a set of golf club irons, the longer irons (i.e. 2, 3, 4) often have a longer blade length resulting in a recess with a greater heel to toe distance. In shorter irons (i.e. 8, 9, PW), the cavity back recess is often shorter from heel to toe than the long irons. In the past, manufacturers provided a different sized medallion to fit the particular cavity recess for each club head. Medallion 31 is configured to allow the medallion length to be adjusted to fit different recess lengths.

Figure 5:
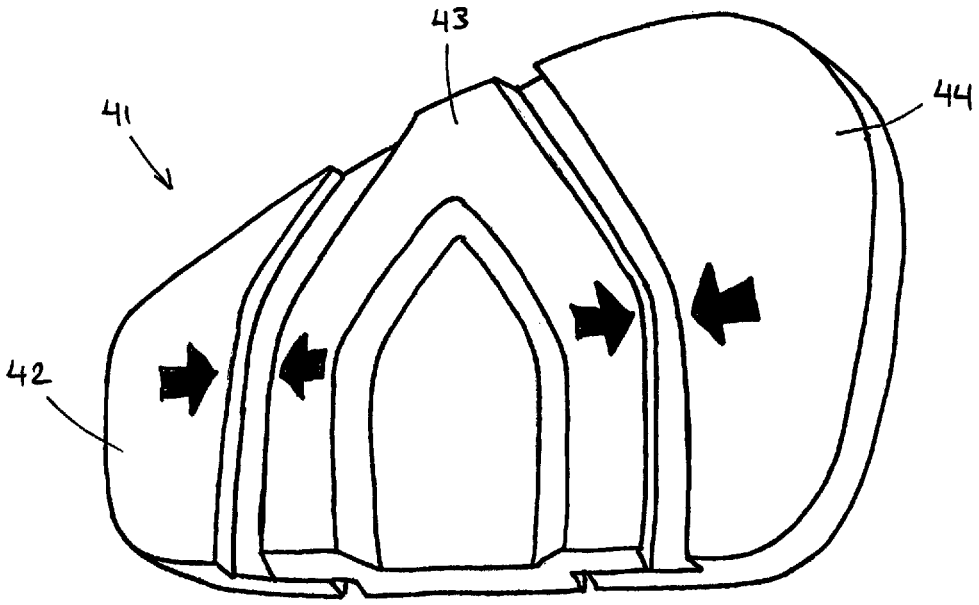
FIG. 5 is a perspective back view of another medallion in a closed position.

As a still further alternative, medallion 41, illustrated in FIG. 5, includes a multi-piece construction having more than two pieces. In particular, medallion 41 has a three piece construction including a heel piece 42, a center piece 43 and a toe piece 44. Each of the heel and toe pieces 42, 44 overlap and are adjustable relative to the center piece 43 so that the overall size of medallion 41 may be adjusted. Additionally, the three-piece configuration increases the flexibility in the overall weight and in locating the center of gravity of the medallion 41 by selectively constructing the components out of lightweight, midweight and heavy weight materials. For example, to create a toe-weighted medallion 41, heel piece 42 and center piece 43 may be constructed from a lightweight material and toe piece 44 may be constructed of a heavyweight material so that the center of gravity of the medallion 41 is located toward the toe piece 44. As alternatives the weight may have a center of gravity that is located centrally or heelward as desired. Additionally, the medallion 41 may be constructed so that it has a range of overall masses based on the material selection of materials for each of the components.

In accordance with the present invention, it will be appreciated that various aspects of the invention, as well as combinations thereof provide a golf club with an improved manner of redistributing weight from central portions of the golf club to perimeter portions of the clubhead, thereby increasing the face area and sweet spot without detrimentally altering overall weight or handling characteristics of the club.

It is claimed:

1. A golf club head comprising:

an iron type golf club head body having a back portion;

a recess defined by a perimeter wall in the back portion, the recess having a back surface; and an adjustable medallion affixed to the back surface of the club head, at least partially covering the back surface, wherein the medallion comprises a first member having a flange and a second member having a flange, wherein the flanges of the first and second members overlap so that the first and second members are adjustable relative to each other by altering the amount of overlap to alter the size of the medallion to accommodate the recess of the club head.

2. The golf club head of claim 1, wherein the first and second members are adjustable relative to each other by at least 0.0625 inch.

3. The golf club head of claim 1, wherein the first member is a heel piece, and the second member is a toe piece.

4. The golf club head of claim 1, wherein the adjustable medallion further comprises a third member having a flange, wherein the second member has a second flange and the flange of the third member and the second flange of the second member overlap.

5. The golf club head of claim 1, wherein the first member is a top piece, and the second member is a bottom piece.

6. The golf club head of claim 5, wherein a gap is defined between the pieces adjacent the overlapping flanges;

the top piece having an L-shaped cutout forming a thick section in abutment with a corresponding L-shaped cutout in the bottom piece;

the cutout sections capable of sliding to and from each other to create various sized gaps, and subsequently varied medallion sizes.

7. The golf club head of claim 1, wherein the medallion is adjusted from small for use in long irons and large for the short irons of a golf club set.

8. The golf club head of claim 1, wherein the medallion is affixed to the back surface by welding, adhesives or epoxies.

9. The golf club head of claim 1, wherein the medallion is formed from a polymer or a metal.

10. The golf club head of claim 1, wherein the first member is constructed from a first material and the second member is constructed from a second material, the first material having a specific gravity that is different than a specific gravity of the second material.

11. A golf club head comprising:

an iron type golf club head body having a back portion;

a recess defined by a perimeter wall in the back portion, the recess having a back surface; and an adjustable medallion affixed to the back surface of the club head, at least partially covering the back surface, wherein the medallion comprises a first member having a flange and a second member having a flange, wherein the flanges of the first and second members overlap so that the first and second members are adjustable relative to each other by altering the amount of overlap to alter the size of the medallion to accommodate the recess of the club head, wherein the first member is a heel piece, and the second member is a toe piece, and wherein the first member is constructed from a first material and the second member is constructed from a second material, the first material having a specific gravity that is different than a specific gravity of the second material.

12. The golf club head of claim 11, wherein the first and second members are adjustable relative to each other by at least 0.0625 inch.

13. The golf club head of claim 11, wherein a gap is defined between the pieces adjacent the overlapping flanges;

the top piece having an L-shaped cutout forming a thick section in abutment with a corresponding L-shaped cutout in the bottom piece;

the cutout sections capable of sliding to and from each other to create various sized gaps, and subsequently varied medallion sizes.

14. The golf club head of claim 11, wherein the medallion is adjusted from small for use in long irons and large for the short irons of a golf club set.

15. The golf club head of claim 11, wherein the medallion is affixed to the back surface by welding, adhesives or epoxies.

16. The golf club head of claim 11, wherein the medallion is formed from a polymer or a metal.

17. A golf club head comprising:

an iron type golf club head body having a back portion;

a recess defined by a perimeter wall in the back portion, the recess having a back surface; and an adjustable medallion affixed to the back surface of the club head, at least partially covering the back surface, wherein the medallion comprises a first member having a flange, a second member having first and second flanges, and a third member having a flange, wherein the flange of the first member and the first flange of the second member overlap so that the first and second members are adjustable relative to each other, and the second flange of the second member and the flange of the third member overlap so that the second and third members are adjustable relative to each other by altering the amount of overlap to alter the size of the medallion to accommodate the recess of the club head, wherein the first member is constructed from a first material and the second member is constructed from a second material, the first material having a specific gravity that is different than a specific gravity of the second material.

18. The golf club head of claim 17, wherein the first and second members are adjustable relative to each other by at least 0.0625 inch, and the second and third members are adjustable relative to each other by at least 0.0625 inch.

19. The golf club head of claim 17, wherein the adjustable medallion further comprises a third member having a flange, wherein the second member has a second flange and the flange of the third member and the second flange of the second member overlap, and wherein a gap is defined between the pieces adjacent the overlapping flanges; the top piece having an L-shaped cutout forming a thick section in abutment with a corresponding L-shaped cutout in the bottom piece; the cutout sections capable of sliding to and from each other to create various sized gaps, and subsequently varied medallion sizes.

20. The golf club head of claim 17, wherein the medallion is adjusted from small for use in long irons and large for the short irons of a golf club set.

* * * * *